US009347623B2

(12) United States Patent
Verbeek et al.

(10) Patent No.: US 9,347,623 B2
(45) Date of Patent: May 24, 2016

(54) REFLECTOR DEVICE AND LIGHTING DEVICE COMPRISING SUCH A REFLECTOR DEVICE

(71) Applicant: KONINKLIJKE PHILIPS N.V., Eindhoven (NL)

(72) Inventors: Gilbert Martinus Verbeek, Eindhoven (NL); Martinus Hermanus Wilhelmus Maria Van Delden, Venlo (NL); Henricus Johannes Joseph Bouwens, Veldhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 10 days.

(21) Appl. No.: 14/368,820

(22) PCT Filed: Dec. 17, 2012

(86) PCT No.: PCT/IB2012/057380

§ 371 (c)(1),
(2) Date: Jun. 26, 2014

(87) PCT Pub. No.: WO2013/098700

PCT Pub. Date: Jul. 4, 2013

(65) Prior Publication Data

US 2014/0340896 A1 Nov. 20, 2014

Related U.S. Application Data

(60) Provisional application No. 61/580,365, filed on Dec. 27, 2011.

(51) Int. Cl.

| | |
|---|---|
| ***F21K 99/00*** | (2010.01) |
| ***F21V 7/00*** | (2006.01) |
| ***F21V 7/04*** | (2006.01) |
| *F21Y 101/02* | (2006.01) |
| *F21Y 103/00* | (2016.01) |
| *F21Y 111/00* | (2016.01) |
| *F21V 3/00* | (2015.01) |

(52) U.S. Cl.
CPC ... *F21K 9/54* (2013.01); *F21K 9/13* (2013.01); *F21K 9/135* (2013.01); *F21V 7/0008* (2013.01); *F21V 7/04* (2013.01); *F21K 9/17* (2013.01); *F21V 3/00* (2013.01); *F21Y 2101/02* (2013.01); *F21Y 2103/003* (2013.01); *F21Y 2111/001* (2013.01)

(58) Field of Classification Search
CPC ..... F21K 9/54
See application file for complete search history.

(56) References Cited

U.S. PATENT DOCUMENTS

| | | | | |
|---|---|---|---|---|
| 2007/0171676 | A1 | 7/2007 | Chang | |
| 2008/0024797 | A1 * | 1/2008 | Otsuka | G01D 5/38 356/616 |
| 2008/0094835 | A1 * | 4/2008 | Marra | F21K 9/54 362/247 |
| 2010/0172133 | A1 | 7/2010 | Liu | |
| 2011/0163683 | A1 | 7/2011 | Steele et al. | |

FOREIGN PATENT DOCUMENTS

| | | | |
|---|---|---|---|
| CN | 1993581 | A | 7/2007 |
| WO | 2008011723 | A2 | 1/2008 |

* cited by examiner

*Primary Examiner* — Anne Hines

(57) ABSTRACT

A reflector device comprising a reflector (106), having an inner surface (120, 122), and at least one solid state light emitting element (114). The inner surface of the reflector comprises first and second surface portions (120, 122), which are flat and which extend in planes intersecting at an angle. The at least one solid state light emitting element (114) is mounted at at least one of said first and second surface portions (120,122) such that a major part of the light emitted from said at least one solid state light emitting element (114) illuminates the other one of said first and second surface portions (120,122).

13 Claims, 11 Drawing Sheets

REFLECTOR DEVICE AND LIGHTING DEVICE COMPRISING SUCH A REFLECTOR DEVICE

CROSS-REFERENCE TO PRIOR APPLICATIONS

This application is the U.S. National Phase application under 35 U.S.C. §371 of International Application No. PCT/IB032012/057380, filed on Dec. 17, 2012, which claims the benefit of [e.g., U.S. Provisional Patent Application No. or European Patent Application No.] 61/580365, filed on Dec. 27, 2011. These applications are hereby incorporated by reference herein.

FIELD OF THE INVENTION

The present invention relates to a reflector device comprising a reflector, having an inner surface, and at least one solid state light emitting element, and to a lighting device comprising such a reflector device.

BACKGROUND OF THE INVENTION

Recent years traditional fluorescent tubes have been modernized in that the outer features of the tube and the electric connection parts have been kept but the light engine has been replaced with modern technology of one or more solid state light emitting elements, such as LEDs (Light Emitting Diodes), and OLEDs (Organic Light Emitting Diodes), etc. One example thereof is EnduraLED T8 manufactured by Philips. Typically, several solid state light emitting elements are mounted in a line on a carrier, which is introduced into a glass tube, and the inside of the glass tube is provided with a light diffuser, which diffuses the spot shaped light from the solid state light emitting elements into a homogeneous light output. Present light diffusers obtain the diffusing effect by a combination of reflection and scattering transmission of the light. However, in order to obtain a good uniformity of light distribution the solid state light emitting elements have to be densely mounted or the light diffuser has to be reflective to a high extent. A high reflectivity causes a low optical efficiency. Densely mounted solid state light emitting elements cause a high cost.

SUMMARY OF THE INVENTION

It is an object of the present invention to provide a lighting device that alleviates the above-mentioned problems of the prior art, and provides a homogeneous light output with high optical efficiency at less densely mounted solid state light emitting elements than the prior art lighting devices.

The object is achieved by a reflector device according to the present invention as defined in claim 1.

The invention is based on the insight that avoidance of a direct light path from the solid state light emitting elements to the viewer creates a basis for solving the prior art problems.

Thus, in accordance with an aspect of the present invention, there is provided a reflector device comprising a reflector, having an inner surface, and at least one solid state light emitting element. The inner surface of the reflector comprises first and second surface portions, which extend in planes intersecting at an angle. The at least one solid state light emitting element is/are mounted at at least one of said first and second surface portions such that a major part of the light emitted from said at least one solid state light emitting element illuminates the other one of said first and second surface portions. The first and second surface portions may be flat.

By arranging the solid state light emitting elements at the reflector, and arrange them to emit light towards the reflector inner surface, the light is being more diverged before being outlet to the surrounding environment, which results in that, when using several solid state light emitting elements the distance between them can be larger than in the prior art lighting device, while still obtaining a uniform light output. Additionally, the freedom of positioning the solid state light emitting elements is increased. The mounting of the at least one solid state light emitting element together with the emission direction of the generated light ensures that the generated light, or at least a major part of it, leaves the reflector after being reflected at least once by the reflector. The amount of light, if any, that is not reflected by the reflector has a negligible effect on how the light is perceived by a viewer.

In accordance with an embodiment of the reflector device, the first and second surface portions define a V-shaped groove. This is an efficient shape.

In accordance with an embodiment of the reflector device, it further comprises an intermediate inner surface portion interconnecting the first and second inner surface portions, wherein the intermediate inner surface portion extends non-parallel to said planes. The intermediate inner surface portion further increases the efficiency.

In accordance with an embodiment of the reflector device, each one of the first and second surface portions has a free side edge, wherein the free side edges define a reflector opening, said at least one solid state light emitting element being mounted at a distance from the free side edge of the surface portion at which it is mounted. In other words, the side edges constitute the rim of the reflector. This positioning of the at least one solid state light emitting element ensures that no shadow effect is caused by the at least one solid state light emitting element, which could be the case in some applications if mounted at the very edge.

In accordance with an embodiment of the reflector device, at least one of said first and second surface portions comprises a diffuse reflective portion. The diffusion arranged already at the reflector further increases the homogeneity of the outlet light.

In accordance with an embodiment of the reflector device, wherein the at least one solid state light emitting element extends through the reflector, such that a light emitting portion of each solid state light emitting element protrudes from an inner surface of the reflector while a support portion of each solid state light emitting element is positioned at an outer surface of the reflector, wherein the support portion supports the light emitting portion. This is an advantageous mounting where the reflector surface is maximized.

In accordance with an embodiment of the reflector device, at least one of said first and second surface portions constitutes a top surface of a printed circuit board.

In accordance with an embodiment of the lighting device, the at least solid state emitting element comprises a solid state light emitting element, which is arranged to have a centre emitting direction which is non-perpendicular to the intersection axis between the first and second surface portions. Thereby, the optical path length within the reflector device is increased.

In accordance with an embodiment of the lighting device, it comprises a light diffuser, which includes the light outlet portion. Thus, since the light outlet portion is provided with light diffusing properties, no separate light diffusing means has to be arranged.

For the purposes of this application it should be noted that by "light diffusing", and similar expressions, is meant different kinds of light diffusing properties, such as for instance diffuse and specular transmission, and diffuse or specular reflection. Typically, the light diffusing means provides a combination of several different kinds Furthermore, the light diffusing means can be a separate part, a coating or a stack of one or more photo-luminescent materials integrated in the light outlet portion, etc. As regards the reflector, it can be specular reflective, diffuse reflective or a combination thereof. Furthermore, the reflector may constitute a film of one or more photo-luminescent materials such as remote phosphor.

These and other aspects, and advantages of the invention will be apparent from and elucidated with reference to the embodiments described hereinafter.

BRIEF DESCRIPTION OF THE DRAWINGS

The invention will now be described in more detail and with reference to the appended drawings in which.

DESCRIPTION OF PREFERRED EMBODIMENTS

Figure 4:
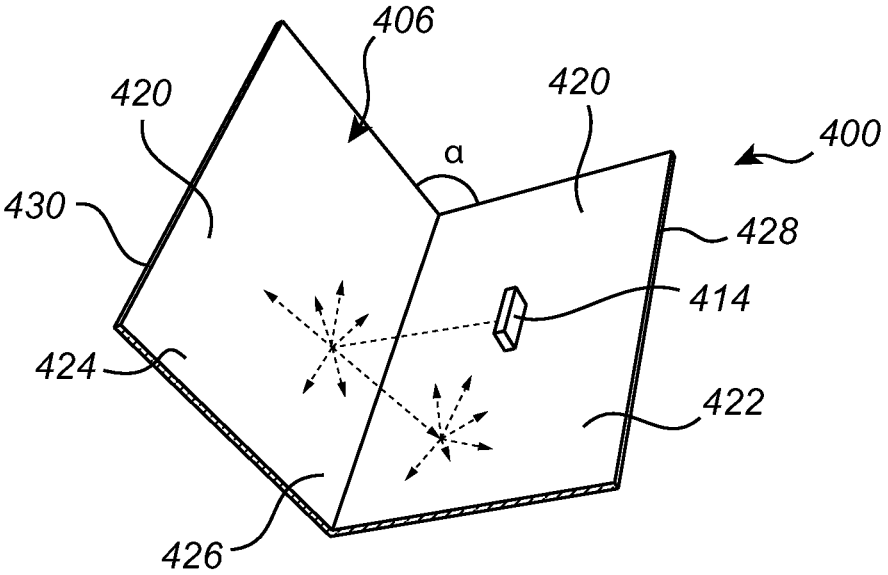

A first embodiment of the reflector device 400 according to this invention, as shown in FIG. 4, comprises a reflector 406, and at least one solid state light emitting element 414. For the purposes of the present application, in the following description the solid state light emitting elements 414 will be exemplified by LEDs (Light Emitting Diodes), while any other kind of solid state light emitting element is applicable as well. In this embodiment a single LED 414 is shown. The LED may emit light of one or more wavelengths.

An inner surface 420 of the reflector 406 comprises first and second surface portions 422, 424, which are flat and which extend in planes intersecting at an angle $\alpha$ of approximately 90°. Thus, the first and second surface portions 422, 424 define a V-shaped groove 426. The angle can differ from 90°. For instance, down to about 80° will also work as well as up to 100° or even 110°, but preferably it is about 90°. The LED 414 is mounted at the first surface portion 422, such that a major part of the emitted light illuminates the second surface portion 424. In this embodiment, this is obtained by having an emitting side of the LED 414 face the second surface portion 424. The inner surface 420 of the reflector 406 is diffuse reflective, i.e. the reflector 406 is provided with a diffusively reflective inner surface 420. Thereby the spreading of the generated light is maximized while obtaining a good efficiency, providing a homogeneous light output. The diffuse reflective surface 420 can be obtained by, for instance, providing the surface with a diffusing pattern, such as a series of dots and/or strips, brushing or any mix of either one or more diffuse and/or specular reflective materials at a diffuse and/or specular reflective surface of the reflector 406. Either one or both of the first and second surface portions 422, 424 can be provided with one or more diffuse reflective portions, or they can both be fully specular reflective. The diffuse reflective portions provide an increase in the homogeneity of the light leaving the reflector 420. When several LEDs are arranged in a row, the distance between the LEDs can be increased compared to prior art bottom-up lit devices while keeping the same homogeneity of the light output. Thereby the manufacturing cost is lowered.

As an additional alternative, one half of the reflector can comprise a metal plate, e.g. tin coated with diffuse white paint, and the other half a highly reflective surface of for example barium sulfate (BaSO4) and/or titanium dioxide (TiO2) coated plastic or paper, MCPET (Micro Cellular PET), etc.

Each one the first and second surface portions 422, 424 has a free side edge 428, 430 wherein the free side edges 428, 430 define a reflector opening. The flat first and second surface portions 422, 424 can be elongated, such that the free side edges 428, 430 are long side edges. The LED 414 is mounted at a distance from the free side edge 428 of the first surface portion 422. In other words, the LED 414 is mounted recessed in the groove 426. The solid state light emitting elements 414 can be mounted non-recessed as well, i.e. at the free edge 428, 430 of the first and/or second flat surface portions 422, 424, but then there is a risk of causing LED self-shadows in the light output of the reflector device, at least in some lighting device applications.

It should be noted that the single LED 414 embodiment is possible, while it is common to have several LEDs arranged at the reflector, on one or both flat surface portions, as will be exemplified below.

Figure 1:
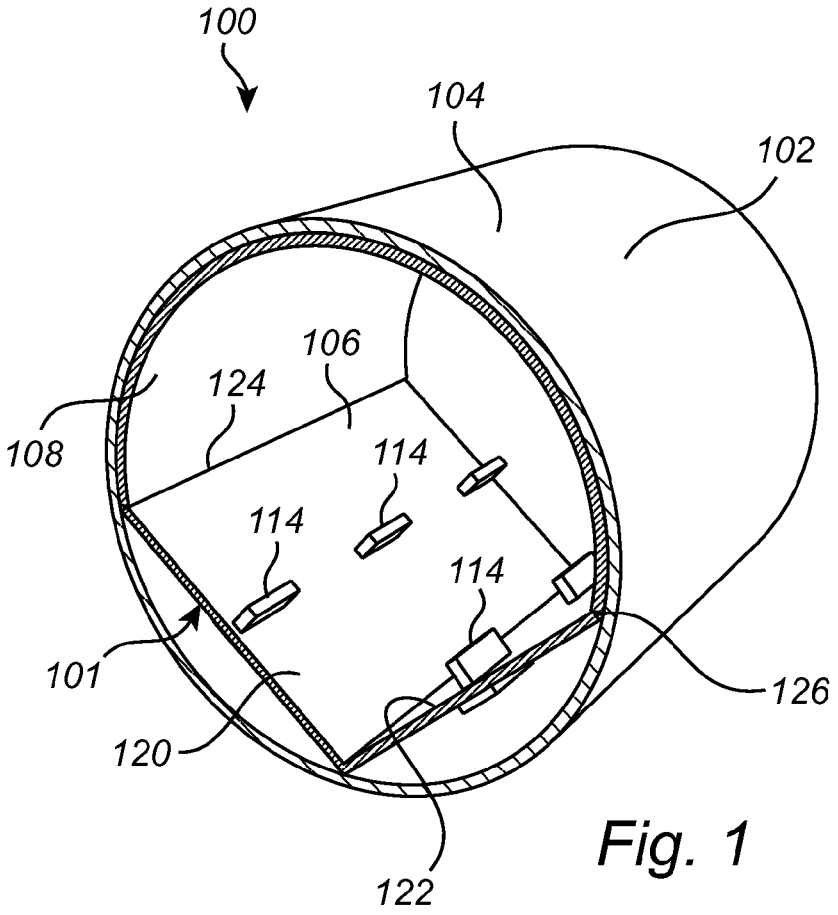
FIG. 1 is a schematic perspective view of a part of an embodiment of a reflector device according to the present invention.
Figure 2:
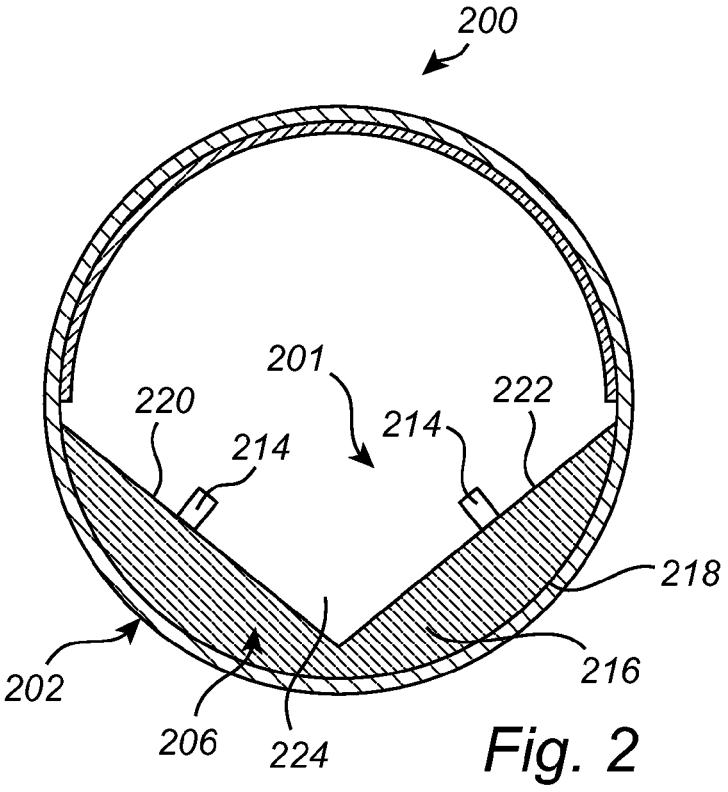
FIG. 2 is a cross-sectional view of another embodiment of the reflector device.

A first embodiment of a lighting device 100 according to this invention, as shown in FIGS. 1 and 2, comprises a reflector device 101 and a light transmissive light outlet portion 104. Furthermore, the lighting device 100 has an elongated tubular portion, which is an outer tube, 102, and which includes the light outlet portion 104. The reflector device 101 comprises a reflector 106 and LEDs 114 mounted at the reflector 106. In fact, in this embodiment, more particularly, the whole outer tube 102 is light transmissive, such as a glass tube, but due to a reflector 106 mounted within in the outer tube 102, and covering about half the outer tube 102, there is left the light outlet portion 104, thus constituting about half the outer tube 102, for the light output of the lighting device 100. Furthermore, a semi-cylindrical light diffuser 108 is arranged inside of the outer tube 102. More particularly, the extension of the light diffuser 108 corresponds with the extension of the light outlet portion 104. The light diffuser 108 is a diffusing layer deposited on the inner surface of the tube 102. Alternatively, the light diffuser can be an individual element, i.e. a separate diffuser, mounted in the tube 102 at a reflector opening, or as a shrink wrap applied at the exterior of the tube 102, or between a reflector opening and the light outlet portion 104. As a further alternative, the diffusing properties can be provided by the light outlet portion 104 itself, thereby saving steps when manufacturing the lighting device 100. On the other hand it can be economically advantageous to be able to use standard transparent glass or plastic tubes. Furthermore, as exemplified above, the reflector 106 can include a diffusing surface, which cooperate with the light diffuser 108 in spreading the light before outlet thereof. The reflector 106 is generally V-shaped, and can be formed like a bent plate. Alternatively, it can be comprised of two portions that can be unfolded after insertion into the tube 102. The reflector 106 has an inner surface, which comprises first and second surface portions 120, 122, which are elongated and flat and extend in planes intersecting at an angle, here a right angle. Thus, the first and second surface portions 120, 122 are rectangular in this embodiment. More particularly, the first and second surface portions 120, 122 preferably extend in orthogonal planes, while other intersection angles are feasible as well although not optimum. The reflector 106 further has first and second free long side edges 124, 126 of the respective first and second surface portions 120, 122 extending longitudinally along the length of the tube 102. The free long side edges 124, 126 define a reflector opening.

The LEDs 114 are mounted at a distance from the free long side edges 124, 126. In other words, the LEDs 114 are mounted recessed in the reflector 106. The LEDs 114 are mounted at both the first surface portion 120, and at the second surface portion 122. They emit light towards the inner surface 120, 122 of the reflector 106. More particularly, the LEDs 114 mounted at one surface portion 120, 122 emit light towards the other surface portion 122, 120. The emitted light is reflected by the reflector 106 and directed out of the reflector opening towards the light outlet portion 104, and passes the light diffuser 108 on its way out. However, the light diffuser 108 is typically reflecting a minor part of the light back towards the interior of the tube 102. Thus, generally, all or the greater part of the emitted light is reflected at least once by the reflector 106 before leaving it through the reflector opening. Alternatively, the LEDs 114 may be mounted only at the first surface portion 120 or only at the second surface portion 122.

Figure 14:
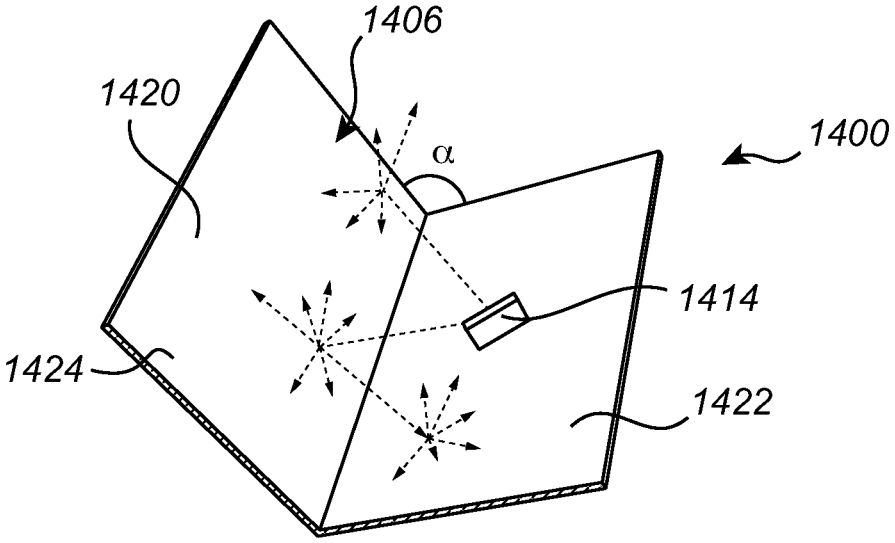

The LEDs 114 are mounted such that the centre direction of the emitted light is parallel with the major surface portion 120, 122 at which the LEDs 114 are mounted, and perpendicular to the other surface portion 122, 120. Thus, the emitting side of each LED 114 is facing the opposite inner surface portion of the reflector 106. Alternatively, as shown in FIG. 14, the LEDs 1414 may be mounted at the reflector 1406 such that the centre direction of the emitted light is parallel with the major surface portion 1420, 1422 of the inner surface 1424 at which the LEDs 1414 are mounted, and under an incident angle of 45 degrees to the other surface portion, 1422, 1420. Other centre incident angles between 30 to 60 degrees are also possible.

A common type of tubular lighting devices 100 has a diameter of 25.4 mm and wall thickness of 1 mm. In order to obtain a good uniformity of the distribution of the light output and a high optical efficiency, for such a lighting device 100, in one example the LEDs 114 were mounted at a spacing, also called pitch, of 30 mm, i.e. the distance between two adjacent LEDs 114.

According to a second embodiment of the lighting device 200, and of the reflector device 201, the reflector 206 is generally semi-cylindrically shaped, and comprises a portion 216, having a semi-cylindrical outer surface 218 abutting against the inside of the tube 202, and an opposite inner surface, which defines a V-shaped groove 224, having first and second surface portions 220, 222, like in the first embodiment of the lighting device 100. The LEDs 214 are arranged on the inner surface 220, 222 similarly as in the first embodiment.

Figure 3:
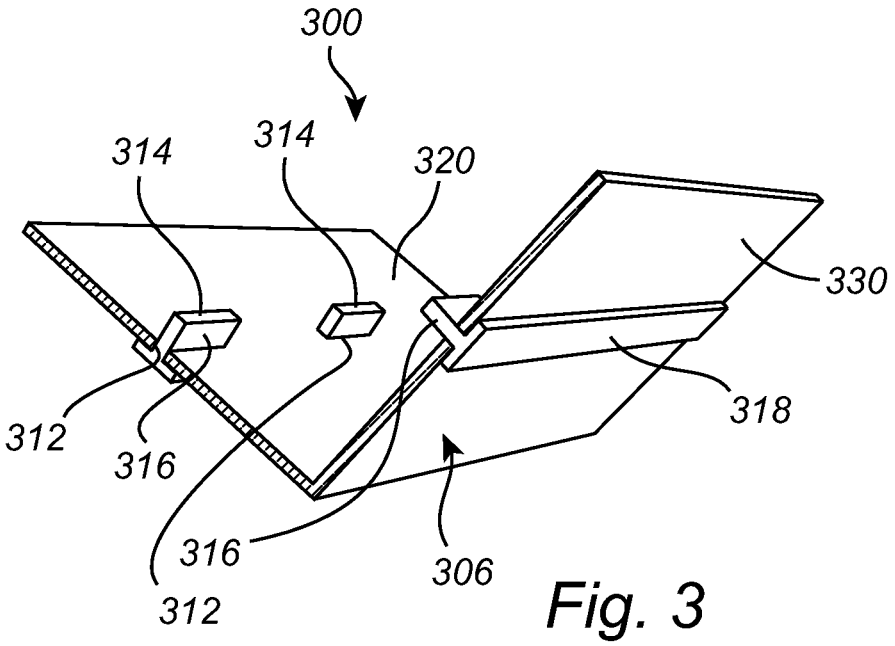
FIGS. 3-16 are schematic views of further embodiments of a reflector device according to the present invention.

According to a third embodiment of the lighting device, and of the reflector device 300, see FIG. 3, the LEDs 314 extend through respective holes 312 of the wall of the reflector 306. For reasons of simplicity, only the reflector and the LEDs are illustrated in FIG. 3. A light emitting portion 316 of each LED 314 protrudes from the inner surface 320 of the reflector 306, while a support portion 318 of the LED 314, which carries the light emitting portion 316, is positioned at an outer surface 330 of the reflector 306. In this embodiment the area of the inner surface 320 of the reflector 306 has been maximized. Alternatively, a small PCB may be mounted at the inner surface 320, and, in order to optimize its reflective properties, be coated with a highly reflective material such as white paint, MCPET, etc. Like above, the light emitting surface of each light emitting portion 316 is turned into the V-shaped groove, i.e. it is facing an opposite inner surface portion of the reflector 306.

Figure 5A:
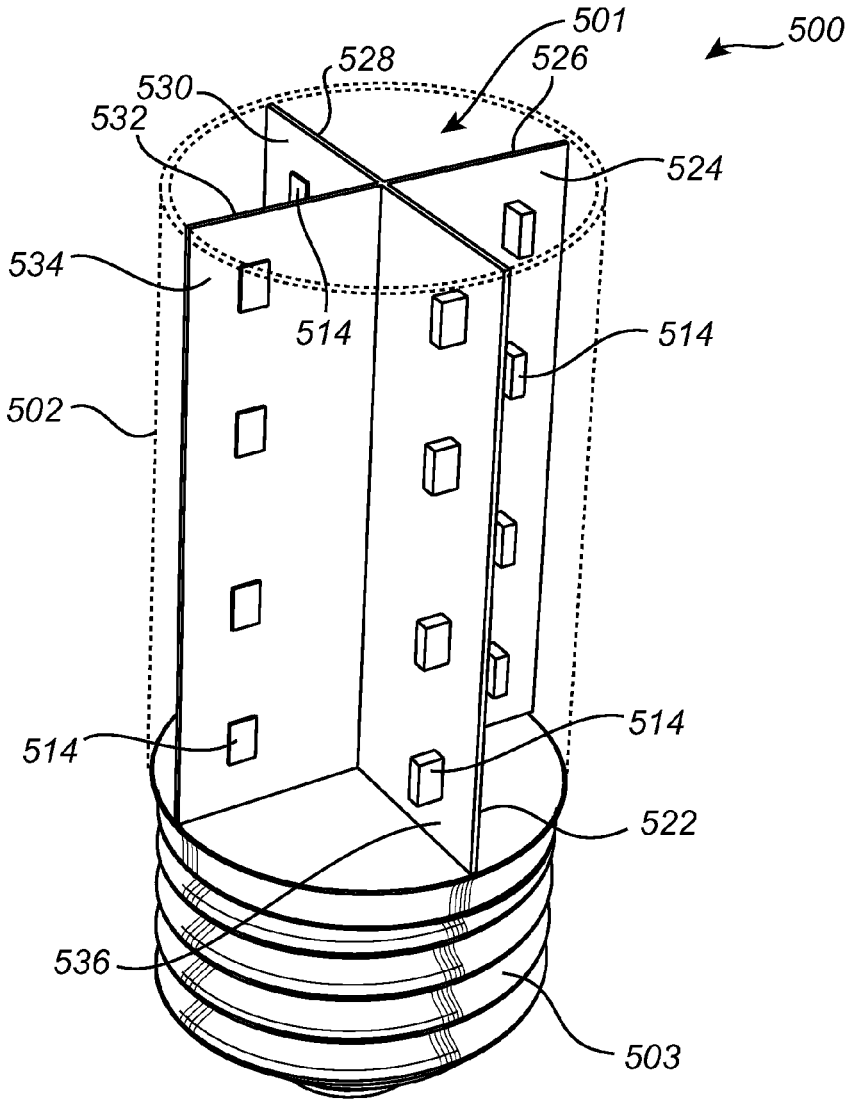
Figure 5B:
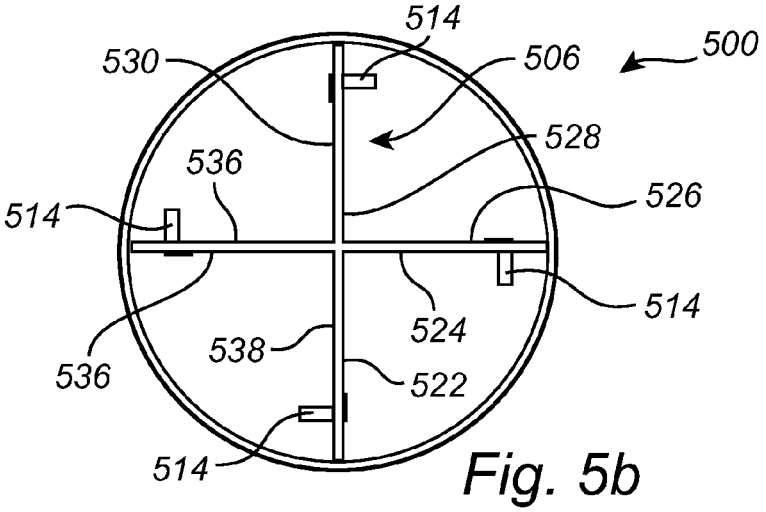
Figure 6:
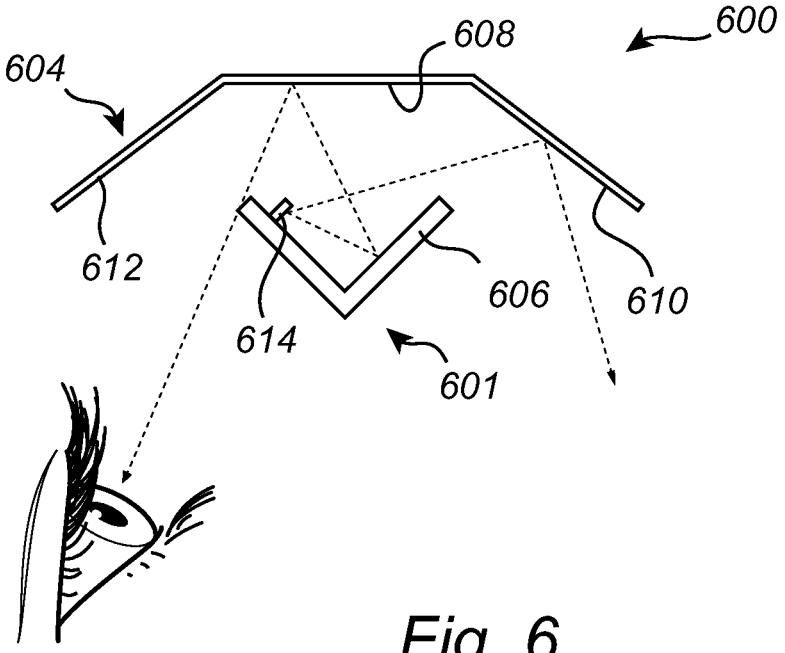

According to a fourth embodiment of the lighting device 500, and reflector device 501, as shown in FIGS. 5*a* and 5*b*, the lighting device 500 is useful e.g. as a retrofit light bulb. It comprises a cylindrical enclosure 502 including a light outlet portion, a socket 503 attached to the enclosure 502, and a reflector device 501 mounted inside of the enclosure 502. The reflector device 501 comprises a reflector, which has a plus (+) shaped cross section, and which embodies four V-shaped grooves, defined by respective pairs of surface portions 522, 524; 526, 528; 530, 532; 534, 536, arranged circumferentially adjacent to each other. The reflector 506 could be regarded as made by two square plates extending in orthogonal planes intersecting at the middle of the plates. LEDs 514 are mounted on at least one of the flat major surface portions of each pair, thereby creating an omnidirectional lighting device. Alternatively, three V-shaped reflectors having an opening angle of 120 degrees may be deployed, and for larger diameter half-tubes, two adjacent V-shaped reflectors, i.e. a half plus (+) arrangement.

According to a fifth embodiment of the lighting device 600 and the reflector device 601, it comprises a V-shaped primary reflector carrying at least one LED 614, and a secondary reflector 604. The primary reflector 606 is arranged with the inside facing the inside of the secondary reflector 604 and at a distance from the secondary reflector 604. The secondary reflector has a flat centre portion 608 and two flat side portions 610, 612, which are integral with the centre portion 608 and are inclined to the centre portion 608. The side portions extend at the respective sides of the primary reflector 606. Light leaving the primary reflector 606 is reflected by the secondary reflector 604 before being outlet from the lighting device 600. This embodiment of the lighting device could typically be used as a ceiling lamp or a wall lamp. The secondary reflector 604 can be made diffuse reflective or specular reflective or any mix thereof. Preferably, the primary reflector 606, just like the secondary reflector 604, is provided with a flat centre portion and two flat side portions, which are integral with the centre portion and are inclined to the centre portion. Then the amount of light that is reflected back to the very LEDs 614 from the secondary reflector 604 and is absorbed by the LEDs 614 is minimized.

Figure 7:
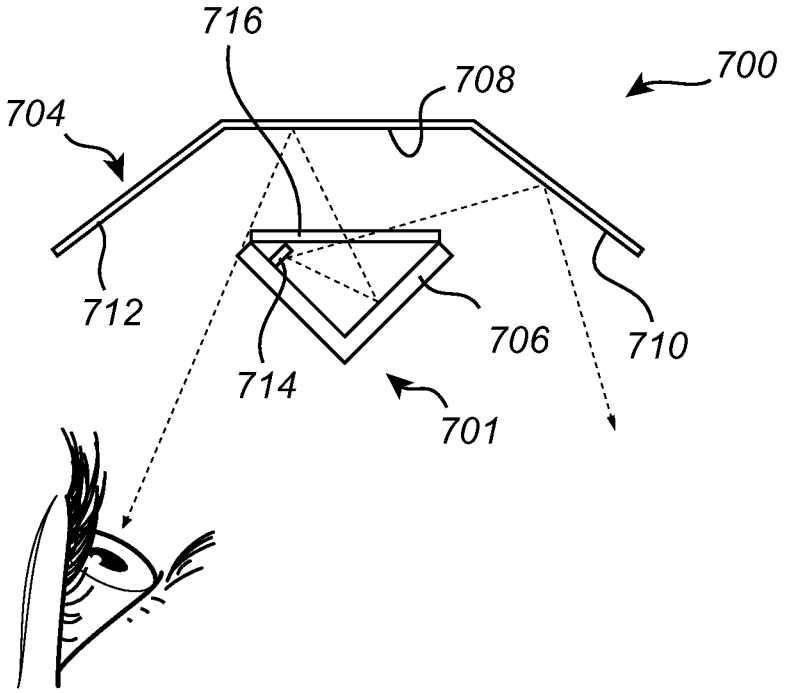

If blue LEDs are used a remote phosphor element can be arranged in the lighting device, such as to cover the primary reflector opening or in some other suitable way, such as at the inner surfaces of the reflector itself, in order to transform the blue light into white light. This is illustrated by a sixth embodiment in FIG. 7, similar to the fifth embodiment, but additionally comprising a remote phosphor element. Thus, the lighting device 700 has a reflector device 701 comprising a V-shaped primary reflector 706, and an opposite secondary reflector 704. The primary reflector 706 is arranged with the inside, carrying at least one LED 714, facing the inside of the secondary reflector 704 and at a distance from the secondary reflector 704. The remote phosphor element 716 is arranged at the opening of the primary reflector 706, covering the opening thereof Thus, the light leaving the primary reflector towards the secondary reflector 704 passes the remote phosphor element 716. Of course, any other embodiment presented herein can be provided with a remote phosphor element as well.

Figure 8A:
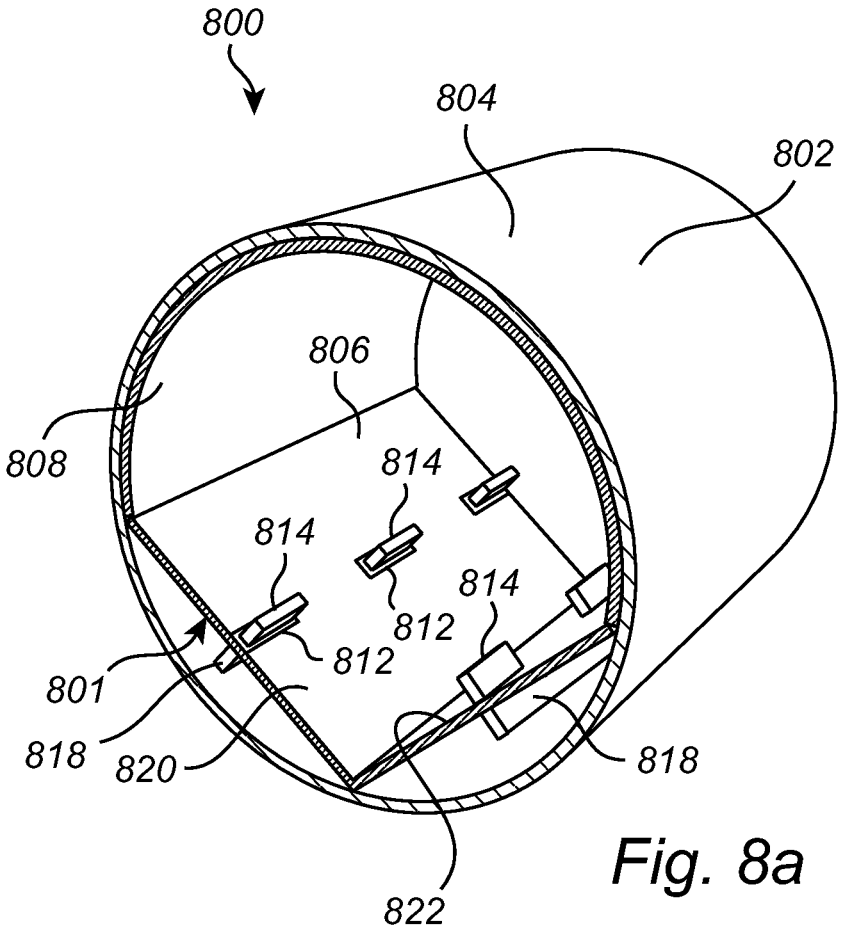
Figure 8B:
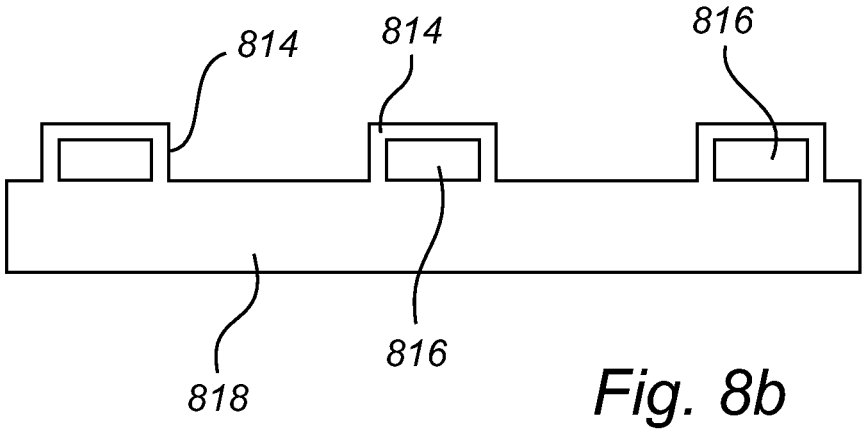

Referring to FIGS. 8*a* and 8*b*, according to a seventh embodiment 800, the reflector device 801 comprises LEDs 814 constituting protrusions of a plate shaped substrate 818. The protrusions 814 extend through holes 812 of the reflector 806, which is V-shaped and has two flat inner surface portions 820, 822. This embodiment is similar to the first embodiment, the only difference being the shape and arrangement of the LEDs 814. Thus, the reflector device 801 is arranged in a cylindrical outer tube 802, which is provided with a semi-cylindrical diffuser 808 on its inner surface. More particularly, as illustrated in FIG. 8*b*, the substrate 818 is elongated and castle-nut shaped, where the "nuts" are the above mentioned protrusions 814. Each protrusion, or LED, 814 has a light emitting area 816. The central emission direction is about perpendicular to the major extension of the substrate 818. Thus, by mounting the substrate 818 at the outer, or rear, side of the reflector 806 such that the "nuts", or protrusions 814 extend through the holes 812 of the reflector 806, perpendicular to the inner surface 820, 822, the LEDs 814 on one inner surface portion 820 emit light towards the other inner surface portion 822. Additionally, by mating the height of the substrate 818 with the distance between the outer surface of the reflector 806 and the inner surface of the outer tube 802 the substrate 818 is supported by the outer tube 802.

Figure 9:
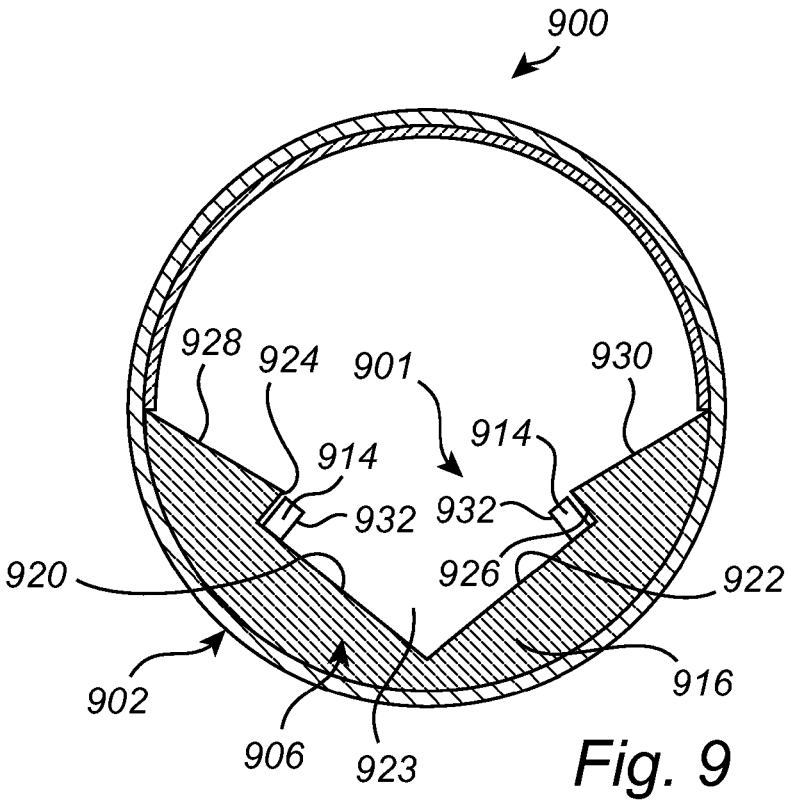

According to further embodiments, the reflector is formed with additional surface portions, as will now be exemplified. According to an eighth embodiment shown in FIG. 9, there is provided a lighting device 900 comprising an outer tube 902 and a reflector device 901 arranged within the outer tube 902. The reflector device 901 comprises a reflector 906 having a body portion 916 with a semi-cylindrical outer surface 918 abutting against the inside of the tube 902, and first and second inner surface portions 920, 922, which are engaged at an angle at a centre of the reflector 906, thereby forming a V-shaped groove 923. Furthermore, it comprises third and fourth inner surface portions 924, 926 engaged with a respective one of the first and second inner surface portions 920, 922, and extending perpendicular to the respective first and second inner surface portions 920, 922 to a low height. Finally, fifth and sixth inner surface portions 928, 930 are engaged with a respective one of the third and fourth inner surface portions 924, 926, and extend slopingly relative to the first and second inner surface portions 920, 922 to the inner surface of the outer tube 902. The LEDs 914 are mounted at the third and fourth inner surface portions 924, 926 with their respective emitting surface 932 facing the opposite second and first inner surface portion 922, 920, respectively. Thus, an additional LED mounting portion is arranged on either half of the reflector inner surface.

Figure 10A:
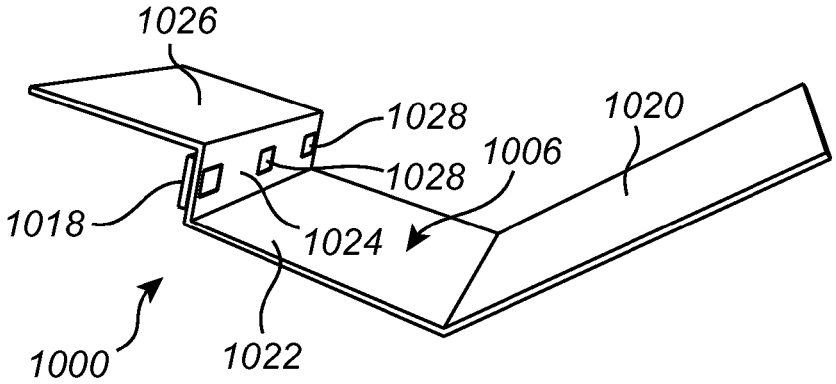
Figure 10B:
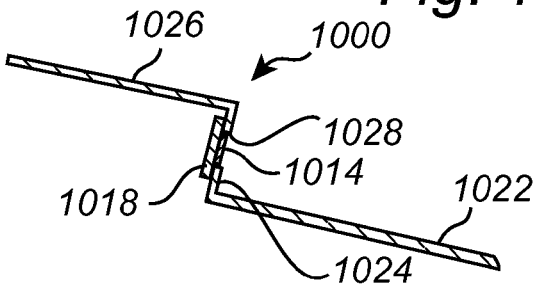

An alternative to the LED mounting of the eighth embodiment is shown in FIGS. 10*a* and 10*b*, where one half of the reflector inner surface is provided with the additional mounting portion 1024, the other one being a single flat portion 1020. However, in this alternative the reflector 1006 is basically plate shaped and the substrate 1018 with the LEDs 1014 is mounted at the outer surface of the mounting portion 1024 of the reflector 1006. The emitting surfaces of the substrate 1018 emit light through holes 1028 of the mounting portion 1024 thereby facing the other half 1020 of the inner surface.

Figure 11A:
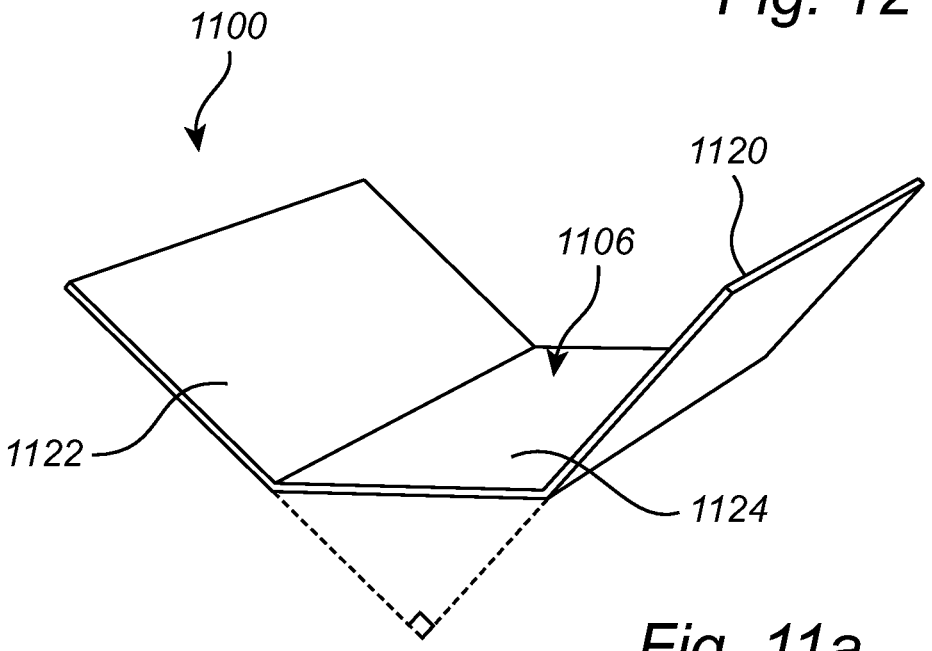
Figure 11B:
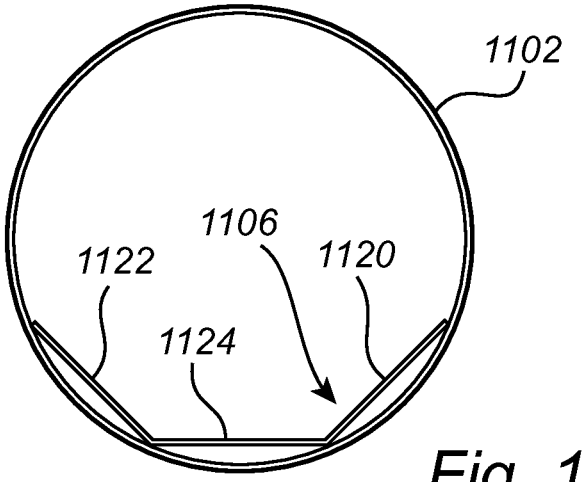

According to a tenth embodiment, as shown in FIGS. 11*a* and 11*b*, the reflector device 1100 comprises a reflector 1106 of a presently preferred shape. The reflector 1106 is shown as such, but of course LEDs and other additional elements will be added as desired, as well as additional shaping of the reflector as exemplified with other embodiments herein. The inner surface of the reflector 1106 has a flat inner surface centre portion 1124 arranged between and engaged with flat first and second inner surface side portions, respectively, at a first angle, typically an obtuse angle. The first and second inner surface side portions 1120, 1122 extend in planes intersecting at a second angle, such as about 90° as described above. Thus, in a sense, the reflector 1106 is tray shaped. When arranged in an outer tube 1102, the reflector can be arranged closer to the tube inner wall than a strictly V-shaped reflector.

Figure 12:
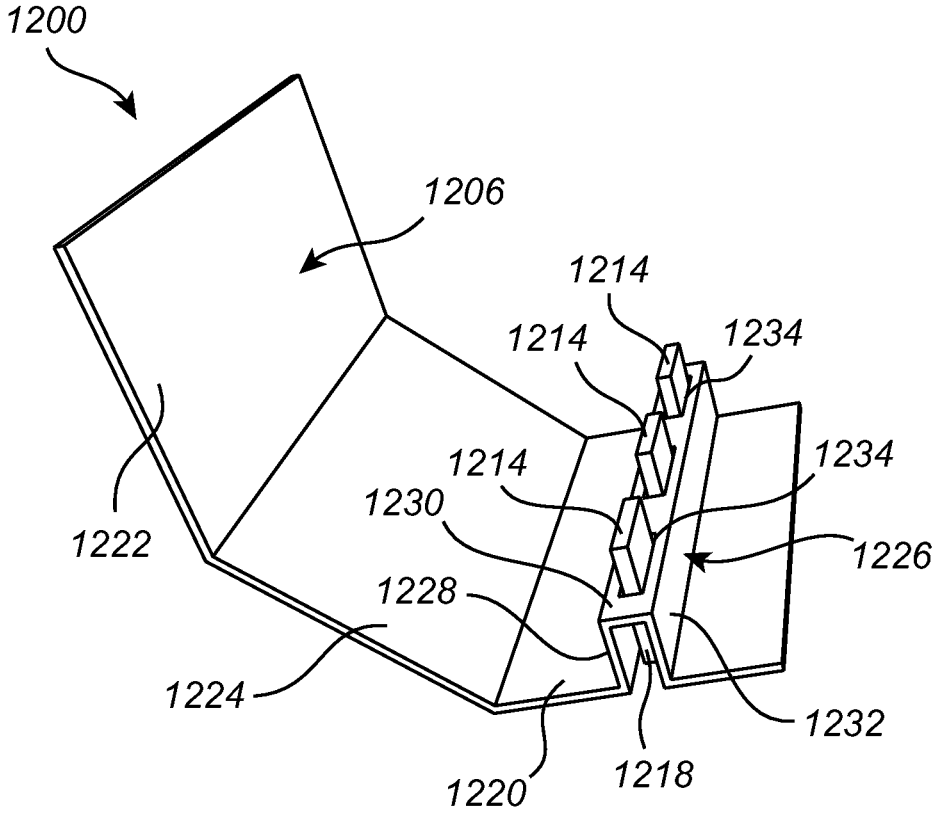

According to an eleventh embodiment, as shown in FIG. 12, the reflector device 1200 comprises a reflector 1206, which is basically shaped like the tenth embodiment having a flat inner surface centre portion 1224 arranged between and engaged with flat first and second inner surface side portions 1220, 1222. However, the first inner surface side portion 1220 is provided with an additional portion 1226, shaped like an angular U in cross-section, which protrudes from the rest of the first inner surface portion 1220, i.e. the basic flat part of it, and which has first and second side walls 1228, 1232 extending in parallel and extending perpendicular to the basic flat part of the first inner surface portion 1220, and a top portion 1230 extending in parallel with the basic flat part of the first inner surface portion 1220. The top portion 1230 is provided with holes 1234. A castle-nut shaped PCB 1218, similar to the one describe above in conjunction with the seventh embodiment, has been received in the groove defined by the U-shaped portion 1226 on the outer surface of the reflector 1206. The LED portions 1214 of the PCB 1218 have been inserted through the holes 1234 and protrude from the top portion 1230, the emitting surfaces facing the central portion and the second inner surface side portion 1222. The U-shaped additional portion, at which the PCB is arranged, is applicable to other basic reflector shapes as well, such as a pure V-shape, as will be understood by the person skilled in the art.

Figure 13A:
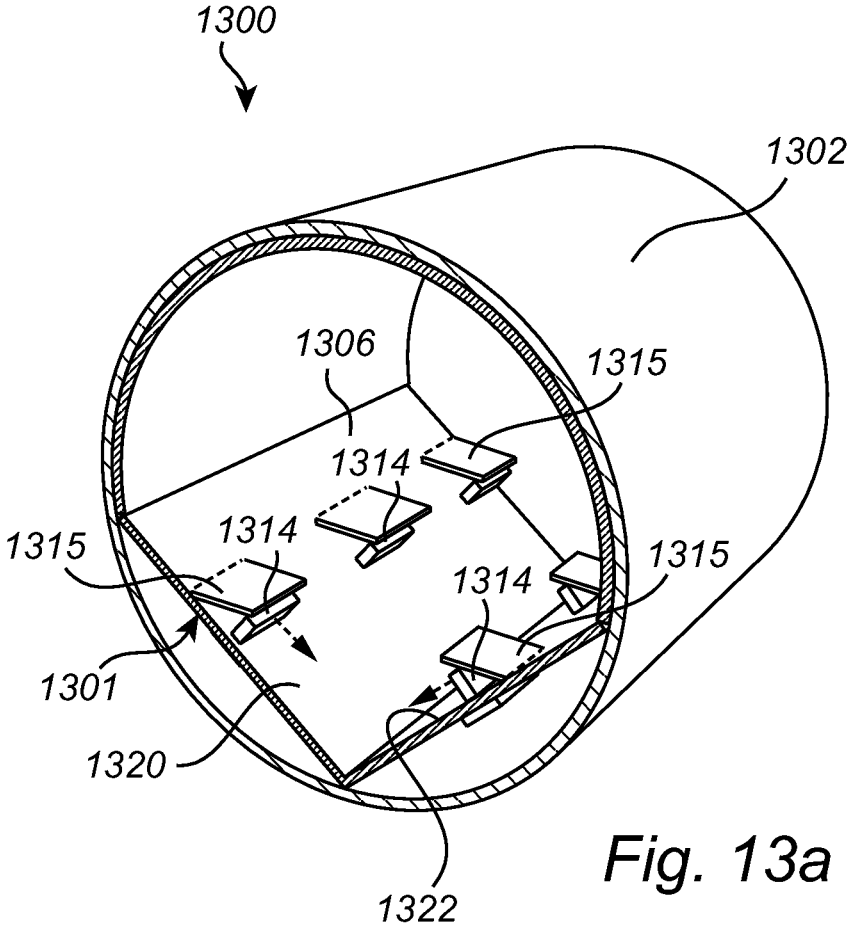
Figure 13B:
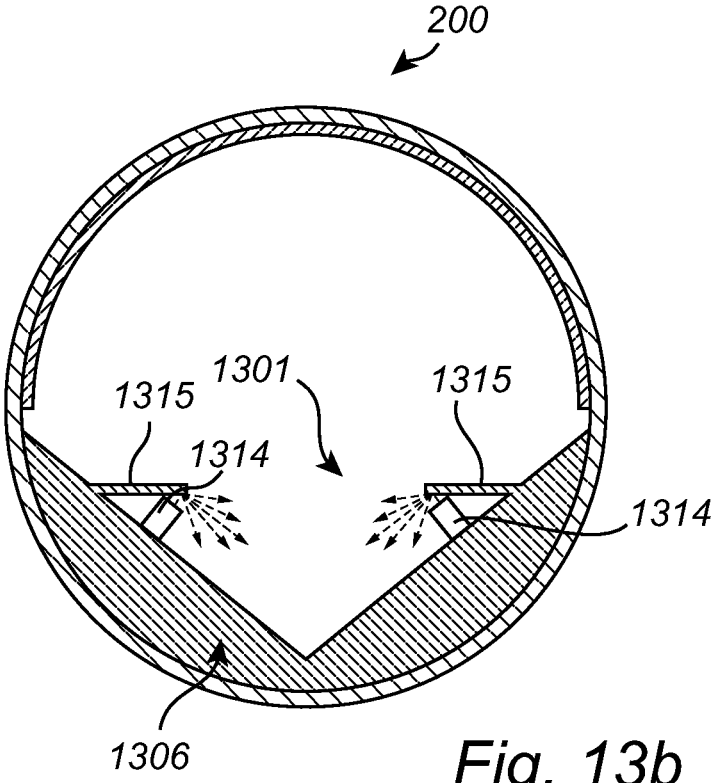

According to a twelfth embodiment 1300, as shown in FIGS. 13*a* and 13*b*, the reflector device 1301 comprises a similar reflector 1306 as in the third embodiment and as in the second embodiment, respectively. Thus, either the LEDs 1314 extend through holes of the reflector walls, or they are attached to the inner surface of the reflector. However, in both cases the LEDs 1314 are top emitting LEDs 1314, thus emitting light along a centre axis perpendicular to the inner surface portion 1320, 1322 of the V-shaped reflector 1306 where they are arranged. In order to avoid direct illumination of the surroundings of the reflector 1306 each LED 1314 is covered by a tongue 1315 attached to the flat inner surface portion 1320, 1322 at one end thereof, and extending above the LED 1314. Thus, the light emitted from the LED 1314 is directed to, and illuminates, the other inner surface portion. Preferably, the surface of the tongue 1315 that faces the LED 1314 is diffuse reflective, and thereby the emitted light is scattered shortly after leaving the LED 1314 and reaches the opposite inner surface portion of the reflector 1306 more scattered than in other embodiments where the LEDs face the opposite inner surface portion. The inner surface portion, or at least a part thereof, at which the LEDs 1314 are arranged can be the printed circuit board that carries the emitting material. In that case, the surface of the printed circuit board has been made reflective in the desired way.

Figure 15A:
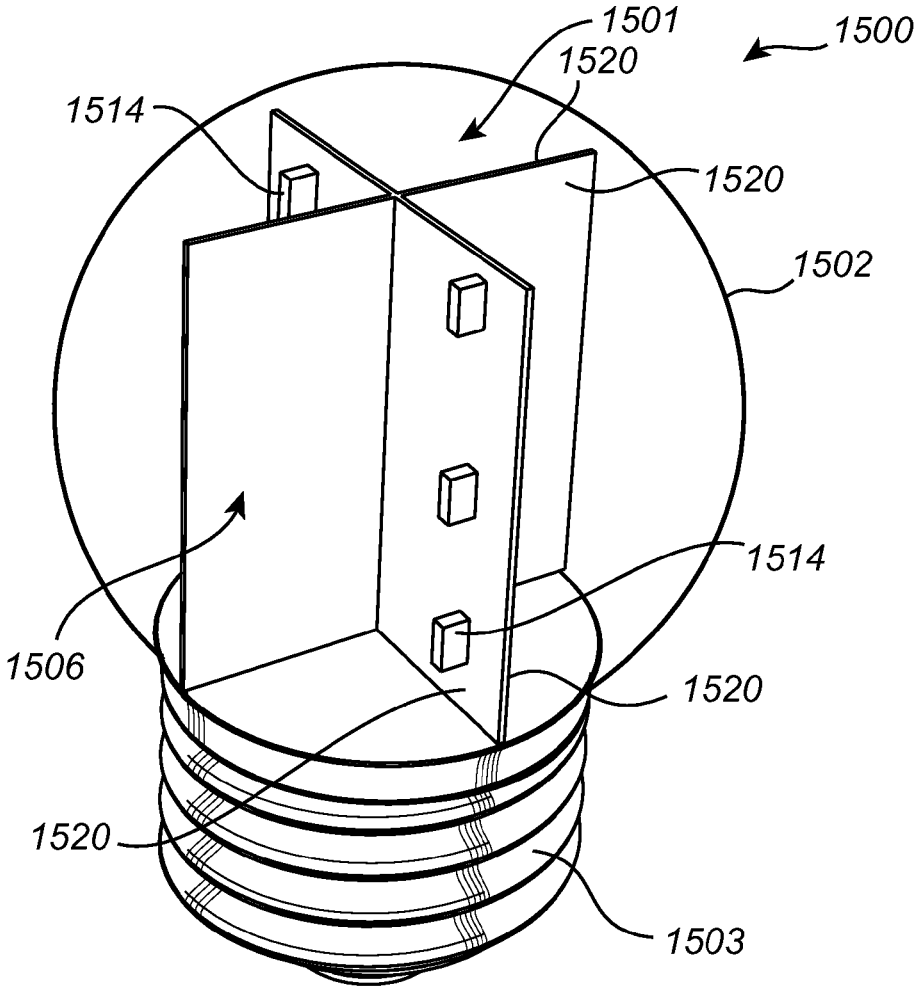
Figure 15B:
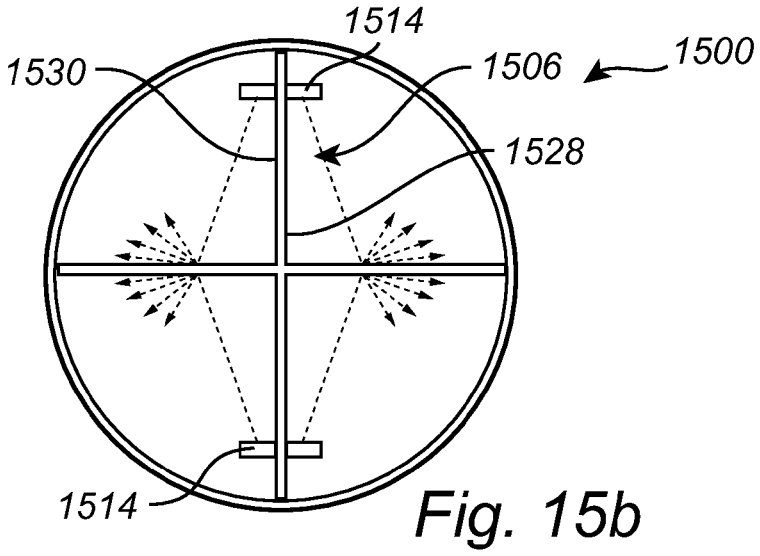

As an alternative to the fourth embodiment, the lighting device 1500, in a thirteenth embodiment as shown in FIGS. 15*a* and 15*b*, comprises a spherical enclosure 1502 instead of the cylindrical enclosure 502 of the fourth embodiment, attached to the socket 1503. The reflector device 1501 comprises a reflector 1506, which has a plus (+) shaped cross section, and which embodies four V-shaped grooves, defined by respective pairs of flat surface portions 1520. If the reflector 1506 is instead regarded as consisting of two plates arranged perpendicular to each other and intersecting each other at the middle of each plate, the LEDs 1514 are arranged on one of the plates, and aligned in pairs with the LEDs of each pair being arranged on the opposite sides 1528, 1530 of the plate. Furthermore, the pairs are arranged in one line on one side of the middle and another line on the other side of the middle. Thereby, each V-shaped groove houses one line of LEDs 1514.

Figure 16:
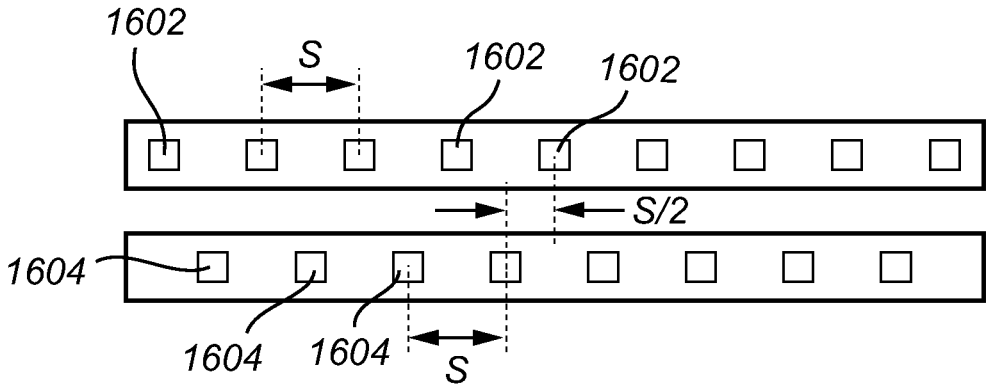

When arranging LEDs on both inner surface portions of the reflector as described in various embodiments above, one line on each inner surface portion, it is advantageous to arrange the LEDs as most schematically illustrated in FIG. 16. The LEDs of both lines are mounted with the same spacing S, but the LEDs 1602 of one line are displaced by half the spacing S relative to the LEDs 1604 of the other line.

Above embodiments of the lighting device according to the present invention as defined in the appended claims have been described. These should only be seen as merely non-limiting examples. As understood by the person skilled in the art, many modifications and alternative embodiments are possible within the scope of the invention as defined by the appended claims.

For instance alternative mounting positions of the LEDs are possible in all embodiments, as understood by the person skilled in the art in light of the description. However, the alternative mounting positions may be less favorable than those disclosed herein.

It is to be noted that for the purposes of this application, and in particular with regard to the appended claims, the word "comprising" does not exclude other elements or steps, and the word "a" or "an" does not exclude a plurality, which per se will be evident to a person skilled in the art.

The invention claimed is:

1. A reflector device comprising:

a reflector, having an inner surface, and at least one solid state light emitting element;

wherein the inner surface of the reflector comprises first and second surface portions, which extend in planes intersecting at an angle ($\alpha$), said at least one solid state light emitting element being mounted at at least one of said first and second surface portions such that a major part of the light emitted from said at least one solid state light emitting element illuminates the other one of said first and second surface portions, wherein said first and second surface portions define a V-shaped groove;

wherein a normal of the intersection of the first and second surface portions intersects a transmissive light outlet.

2. The reflector device according to claim 1, wherein said first and second surface portions are flat.

3. The reflector device according to claim 1, wherein each one of said first and second surface portions has a free side edge, wherein the free side edges define a reflector opening, said at least one solid state light emitting element being mounted at a distance from the free side edge of the surface portion at which it is mounted.

4. The reflector device according to claim 3, wherein at least one of said first and second surface portions comprises a diffuse reflective portion, or a specular reflective portion.

5. The reflector device according to claim 4, said at least one solid state light emitting element extending through the reflector, such that a light emitting portion of each solid state light emitting element protrudes from the inner surface of the reflector while a support portion of each solid state light emitting element is positioned at an outer surface of the reflector, wherein the support portion supports the light emitting portion.

6. The reflector device according to claim 5, wherein at least a part of at least one of said first and second surface portions constitutes a top surface of a printed circuit board housing the at least one solid state light emitting element.

7. The reflector device according to claim 6, said at least one solid state emitting element comprising a solid state light emitting element, which is arranged to have a centre emitting direction which is non-perpendicular to the intersection axis between the first and second flat major surface portions.

8. The reflector device according to claim 7, wherein the inner surface of the reflector further comprises a third inner surface portion arranged at the first inner surface portion , and extending in a plane perpendicular to the plane in which the first inner surface portion extends, said at least one solid state light emitting element being engaged with the third inner surface portion, wherein a light emitting surface of the at least one solid state light emitting element faces the second inner surface portion.

9. The reflector device according to claim 8, wherein the first inner surface portion is provided with an additional portion, which is U-shaped in cross-section, which protrudes from the rest of the first inner surface portion, and which has first and second side walls extending in parallel and extending perpendicular to the rest of the first inner surface portion, and a top portion extending in parallel with the rest of the first inner surface portion, wherein said at least one solid state light emitting element is arranged at the U-shaped portion.

10. A lighting device comprising a light transmissive light outlet portion, and a reflector device according to claim 1, wherein light is outlet from the lighting device through a light outlet portion.

11. The lighting device according to claim 10, further comprising a light diffuser, which light diffuser is arranged to diffuse the light before being outlet from the lighting device.

12. The lighting device according to claim 11, wherein the light diffuser comprises the light outlet portion, which is provided with light diffusing properties.

13. The lighting device according to claim 12, comprising a tubular portion, which is elongated and which includes the light outlet portion.

* * * * *